US008963822B2

(12) United States Patent
Yoon et al.

(10) Patent No.: US 8,963,822 B2
(45) Date of Patent: Feb. 24, 2015

(54) DISPLAY APPARATUS

(75) Inventors: Hyun-Sik Yoon, Seoul (KR); Heebum Park, Seongnam-si (KR); Seungsoo Baek, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 604 days.

(21) Appl. No.: 12/761,711

(22) Filed: Apr. 16, 2010

(65) Prior Publication Data

US 2011/0102415 A1 May 5, 2011

(30) Foreign Application Priority Data

Oct. 30, 2009 (KR) ..... 10-2009-0104260

(51) Int. Cl.
*G09G 3/36* (2006.01)

(52) U.S. Cl.
CPC ..... *G09G 3/3614* (2013.01); *G09G 3/3659* (2013.01); *G09G 3/3685* (2013.01); *G09G 2300/0426* (2013.01); *G09G 2300/0434* (2013.01); *G09G 2300/0823* (2013.01); *G09G 2310/08* (2013.01)
USPC ..... 345/100

(58) Field of Classification Search
CPC ..... G09G 3/3685–3/3688
USPC ..... 345/98, 99, 100
See application file for complete search history.

(56) References Cited

U.S. PATENT DOCUMENTS 6,166,714 A * 12/2000 Kishimoto ..... 345/96
7,760,179 B2 * 7/2010 Lee ..... 345/98
8,102,354 B2 * 1/2012 Jung ..... 345/100
8,330,700 B2 * 12/2012 Yamanaka et al. ..... 345/100
2002/0101415 A1 * 8/2002 Song ..... 345/211
2003/0002002 A1 1/2003 Kawachi et al.
2003/0043100 A1 * 3/2003 Moon ..... 345/87
2003/0090448 A1 5/2003 Tsumura et al.
2003/0095091 A1 5/2003 Enomoto et al.
2003/0151572 A1 8/2003 Kumada et al.
2003/0189563 A1 10/2003 Sato et al.
2003/0227433 A1 * 12/2003 Moon ..... 345/100
2004/0041773 A1 * 3/2004 Takeda et al. ..... 345/98
2004/0108988 A1 * 6/2004 Choi ..... 345/96
2004/0125067 A1 * 7/2004 Kim et al. ..... 345/98
2005/0052401 A1 * 3/2005 Lee ..... 345/100
2005/0128170 A1 * 6/2005 Kang et al. ..... 345/87

(Continued)

FOREIGN PATENT DOCUMENTS

CN 1504986 6/2004
CN 101071240 11/2007
CN 101122721 2/2008
EP 0678846 10/1995
EP 1197790 4/2002

(Continued)

*Primary Examiner* — Chanh Nguyen
*Assistant Examiner* — Roy Rabindranath
(74) *Attorney, Agent, or Firm* — F. Chau & Associates, LLC

(57) ABSTRACT

A display apparatus includes a timing controller, a data driver, and display panel. The timing controller outputs a plurality of image signals, a first control signal, and a second control signal. The data driver converts the image signals to first voltages in response to the first control signal, outputs the first voltages, and outputs a second voltage swinging between two different voltage levels in at least one frame unit in response to the second control signal. The display panel includes a plurality of pixels, where each receives a corresponding one of the first voltages and the second voltage to display an image.

11 Claims, 10 Drawing Sheets

(56) References Cited

U.S. PATENT DOCUMENTS

| | | | | |
|---|---|---|---|---|
| 2005/0195149 | A1* | 9/2005 | Ito | 345/98 |
| 2005/0206641 | A1* | 9/2005 | Morita | 345/211 |
| 2005/0253829 | A1* | 11/2005 | Mamba et al. | 345/204 |
| 2006/0007095 | A1* | 1/2006 | Kudo et al. | 345/98 |
| 2006/0125749 | A1* | 6/2006 | Lee et al. | 345/88 |
| 2006/0132463 | A1* | 6/2006 | Lee et al. | 345/173 |
| 2007/0126682 | A1* | 6/2007 | Liu et al. | 345/92 |
| 2007/0262938 | A1* | 11/2007 | Kim | 345/92 |
| 2008/0012819 | A1* | 1/2008 | Lee et al. | 345/100 |
| 2008/0079679 | A1 | 4/2008 | Ozawa | |
| 2008/0225036 | A1 | 9/2008 | Song et al. | |
| 2009/0267882 | A1* | 10/2009 | Kim et al. | 345/92 |

FOREIGN PATENT DOCUMENTS

| | | |
|---|---|---|
| JP | H11142815 | 5/1999 |
| JP | 2001-133808 | 5/2001 |
| JP | 2002-366114 | 12/2002 |
| JP | 2003-208133 | 7/2003 |
| JP | 2003-302951 | 10/2003 |
| JP | 2004-191581 | 7/2004 |
| JP | 2005010721 | 1/2005 |
| JP | 2006-292854 | 10/2006 |
| JP | 2009-122561 | 6/2009 |
| JP | 2009134043 | 6/2009 |
| KR | 1020020048693 | 6/2002 |
| KR | 1020050058046 | 6/2005 |
| KR | 1020050058179 | 6/2005 |

* cited by examiner

Fig. 5A

Px Fq Py

| | | | | | |
|---|---|---|---|---|---|
| + | − | + | − | + | − |
| − | + | − | + | − | + |
| + | − | + | − | + | − |
| − | + | − | + | − | + |
| + | − | + | − | + | − |
| − | + | − | + | − | + |

Fig. 5B

Px Fq+1 Py

| | | | | | |
|---|---|---|---|---|---|
| − | + | − | + | − | + |
| + | − | + | − | + | − |
| − | + | − | + | − | + |
| + | − | + | − | + | − |
| − | + | − | + | − | + |
| + | − | + | − | + | − |

DISPLAY APPARATUS

CROSS-REFERENCE TO RELATED APPLICATION

This application claims priority to Korean Patent Application No. 2009-104260, filed on Oct. 30, 2009, the disclosure of which is incorporated by reference in its entirety herein.

BACKGROUND

1. Technical Field

Embodiments of the inventive concept relate to a display apparatus, and more particularly, to a display apparatus capable of achieving electrical stability.

2. Discussion of Related Art

A liquid crystal display may include pixels having red, green, and blue sub-pixels that control the transmittance of light passing therethrough due to an arrangement of liquid crystals whose orientations are adjusted according to an applied data signal. Each sub-pixel may be charged with a difference voltage between a data voltage applied to a pixel electrode via a thin film transistor and a reference voltage applied to a reference electrode to drive the liquid crystals. The thin film transistor may be turned on in response to a gate-on voltage applied to a gate line, thereby enabling the pixel electrode to be charged with the data signal applied from a data line. The thin film transistor may be turned off in response to a gate-off voltage, thereby enabling the pixel electrode to maintain the charge of the data signal.

However, when a direct current voltage is applied to the reference electrode, it can be difficult to increase the difference voltage charged in the liquid crystals without increasing the voltage level of the reference voltage.

SUMMARY

A display apparatus according to an exemplary embodiment of the inventive concept includes a data driver and display panel having at least one pixel. The data driver outputs data voltages and a voltage alternately swinging between two different voltage levels to the display panel each time at least one frame is displayed on the display panel. The at least one pixel displays an image based on receiving a corresponding one of the data voltages and the swinging voltage.

A display apparatus according to an exemplary embodiment of the inventive concept includes a timing controller, a data driver, and a display panel. The timing controller outputs a plurality of image signals, a first control signal, and a second control signal. The data driver converts the image signals to first voltages in response to the first control signal, outputs the first voltages, and outputs a second voltage swinging between two different voltage levels in at least one frame unit in response to the second control signal. The display panel includes a plurality of pixels, where each receives a corresponding one among the first voltages and the second voltage to display an image.

The data driver may include a converter part and an output buffer. The converter part may include a first converter to convert the plurality of image signals having n bits to the first voltages and a second converter to alternately select one of a first reference signal having n bits or a second reference signal having n bits and convert the selected one of the first or second reference signal to the second voltage. The output buffer may output the first voltages output from the first converter.

According to an exemplary embodiment of the inventive concept, the data driver includes a converter part and an output buffer. The converter part includes a first converter to convert a plurality of image signals to first voltages and a second converter to alternately select one of a first reference signal or a second reference signal, convert the selected first or second reference signal to a second voltage, and output the second voltage. The output buffer outputs the first voltages output from the first converter. The first and second converters may be D-A converters.

According to an exemplary embodiment of the inventive concept, the data driver includes a data output part, a switch part, and a buffer part. The data output part receives a plurality of image signals and an analog driving voltage and selects gray-scale voltages respectively corresponding to the image signals among a plurality of gray-scale voltages displayed between the analog driving voltage and a ground voltage to output the selected gray-scale voltages as the first voltages. The switch part alternately selects one of the analog driving voltage or the ground voltage to output a second voltage and a third voltage having a phase opposite to the second voltage. The buffer part amplifies the second and third voltages.

According an exemplary embodiment of the inventive concept, a data driver receive first and second control signals from a timing controller and alternately generate a swinging voltage swinging in one frame unit and an inverted voltage having a phase opposite to that of the swinging voltage. The data driver may be disposed on a side of a display panel of a display apparatus. The display apparatus may include a control board having the timing controller, a printed circuit board connected to the data driver, and a connection film connecting the control board to the printed circuit board to provide image signals and the first and second control signals from the timing controller to the data driver. Therefore, the swinging voltage and the inverted voltage may be generated by the data driver and applied from the data driver to the display panel without passing through the control board, the connection film, and the printed circuit board.

BRIEF DESCRIPTION OF THE DRAWINGS

The inventive concept will become more readily apparent by reference to the following detailed description when considered in conjunction with the accompanying drawings wherein:

FIG. 5A is an exemplary view showing a polarity of a first voltage applied to a display panel in a q-th frame;

FIG. 5B is an exemplary view showing a polarity of a first voltage applied to a display panel in a (q+1)-th frame;

DETAILED DESCRIPTION OF EXEMPLARY EMBODIMENTS

It will be understood that when an element or layer is referred to as being "on", "connected to" or "coupled to" another element or layer, it can be directly on, connected or coupled to the other element or layer or intervening elements or layers may be present. Like numbers refer to like elements throughout. Hereinafter, the inventive concept will be explained in detail with reference to the accompanying drawings.

Figure 1:
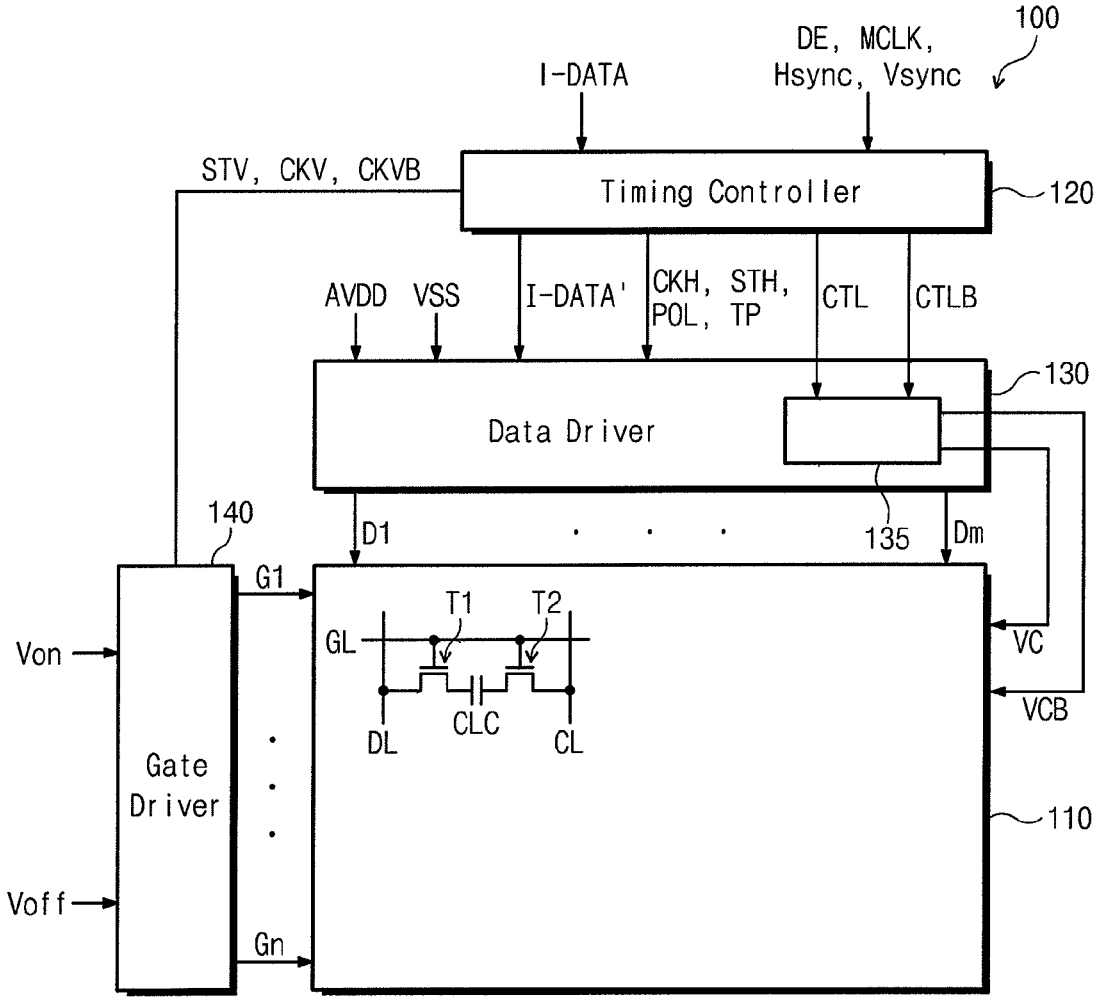
FIG. 1 is a block diagram showing a display apparatus according to an exemplary embodiment of the inventive concept.

FIG. 1 is a block diagram showing a display apparatus according to an exemplary embodiment of the inventive concept. Referring to FIG. 1, a display apparatus 100 includes a display panel 110, a timing controller 120, a data driver 130, and a gate driver 140.

The display panel 110 includes a plurality of pixels. Since one or more of the pixels have the same configuration and function, for the convenience of explanation, only one pixel is shown in FIG. 1. For example, the pixel includes a gate line GL, a first signal line DL crossing the gate line GL, and a second signal line CL substantially in parallel with the first signal line DL. Further, the pixel further includes a first thin film transistor T1 connected to the gate line GL and the first signal line DL, a second thin film transistor T2 connected to the gate line GL and the second signal line CL, and a liquid crystal capacitor CLc connected between the first and second transistors T1 and T2.

The liquid crystal capacitor Clc may include a first pixel electrode electrically connected to a drain electrode of the first thin film transistor T1, a second pixel electrode electrically connected to a drain electrode of the second thin film transistor T2, and liquid crystals, which may be tilted by an electric field formed between the first and second pixel electrodes. For example, the orientations of the liquid crystals may be altered by the electric field.

The timing controller 120 receives a plurality of image signals I-DATA and control signals (e.g., a horizontal synchronization signal Hsync, a vertical synchronization signal Vsync, a clock signal MCLK, and a data enable signal DE). The timing controller 120 converts a data format of the image signals I-DATA into a data format that is appropriate for an interface between the timing controller 120 and the data driver 130, and outputs the converted image signals I-DATA' to the data driver 130. Further, the timing controller 120 provides data control signals (e.g., an output start signal TP, a horizontal start signal STH, a horizontal clock signal CKH, and a polarity reversal signal POL) to the data driver 130 and provides gate control signals (e.g., a vertical start signal STV, a vertical clock signal CKV, and a vertical clock bar signal CKVB) to the gate driver 140.

The gate driver 140 receives a gate-on voltage Von and a gate-off voltage Voff and sequentially outputs gate signals G1~Gn swinging (e.g., alternating) between the gate-on voltage Von and the gate-off voltage Voff in response to the gate control signals (e.g., STV, CKV, and CKVB) provided from the timing controller 120. Accordingly, the display panel 110 may be sequentially scanned by the gate signals G1~Gn.

The data driver 130 receives an analog driving voltage AVDD and a ground voltage VSS. In response to the analog driving voltage AVDD and the ground voltage VSS, the data driver 130 selects gray-scale voltages respectively corresponding to the image signals I-DATA' among gray-scale voltages displayed between the analog driving voltage AVDD and the ground voltage VSS. The data driver 130 outputs the selected gray-scale voltages as first voltages D1~Dm. The first voltages D1~Dm are applied to the display panel 110.

According to an exemplary embodiment, the data driver 130 may further include a voltage generator 135. The timing controller 120 provides a first control signal CTL and a second control signal CTLB having an opposite phase to the first control signal CTL to the voltage generator 135.

The voltage generator 135 outputs a second voltage VC that swings (e.g., alternates) during at least one frame of the display apparatus in response to the first control signal CTL and outputs a third voltage VCB having an opposite phase to the second voltage VC in response to the second control signal CTLB. The second voltage VC and the third voltage VCB are applied to the display panel 110.

Thus, one or more pixels of the display panel 110 may receive either the second voltage VC or the third voltage VCB. For example, one of two adjacent pixels can receive the second voltage VC and a remaining pixel of the two adjacent pixels can receive the third voltage VCB.

When a corresponding gate signal among the gate signals G1~Gn is applied to the gate line GL, the first and second thin film transistors T1 and T2 connected to the gate line GL are turned on in response to the corresponding gate signal. When a first data voltage is applied to the first signal line DL to which the turned-on first thin film transistor T1 is connected, the first data voltage is applied to a first pixel electrode of the liquid crystal capacitor CLc through the turned-on first thin film transistor T1. Further, when the second voltage VC is applied to the second signal line CL, the second voltage VC is applied to a second pixel electrode of the liquid crystal capacitor CLc through the turned-on second thin film transistor T2.

Accordingly, a horizontal electric field may be formed between the first pixel electrode and the second pixel electrode and a light transmittance of the liquid crystals may be controlled by the horizontal electrode field, thereby displaying an image having a desired gray-scale on the display panel 110.

Figure 2:
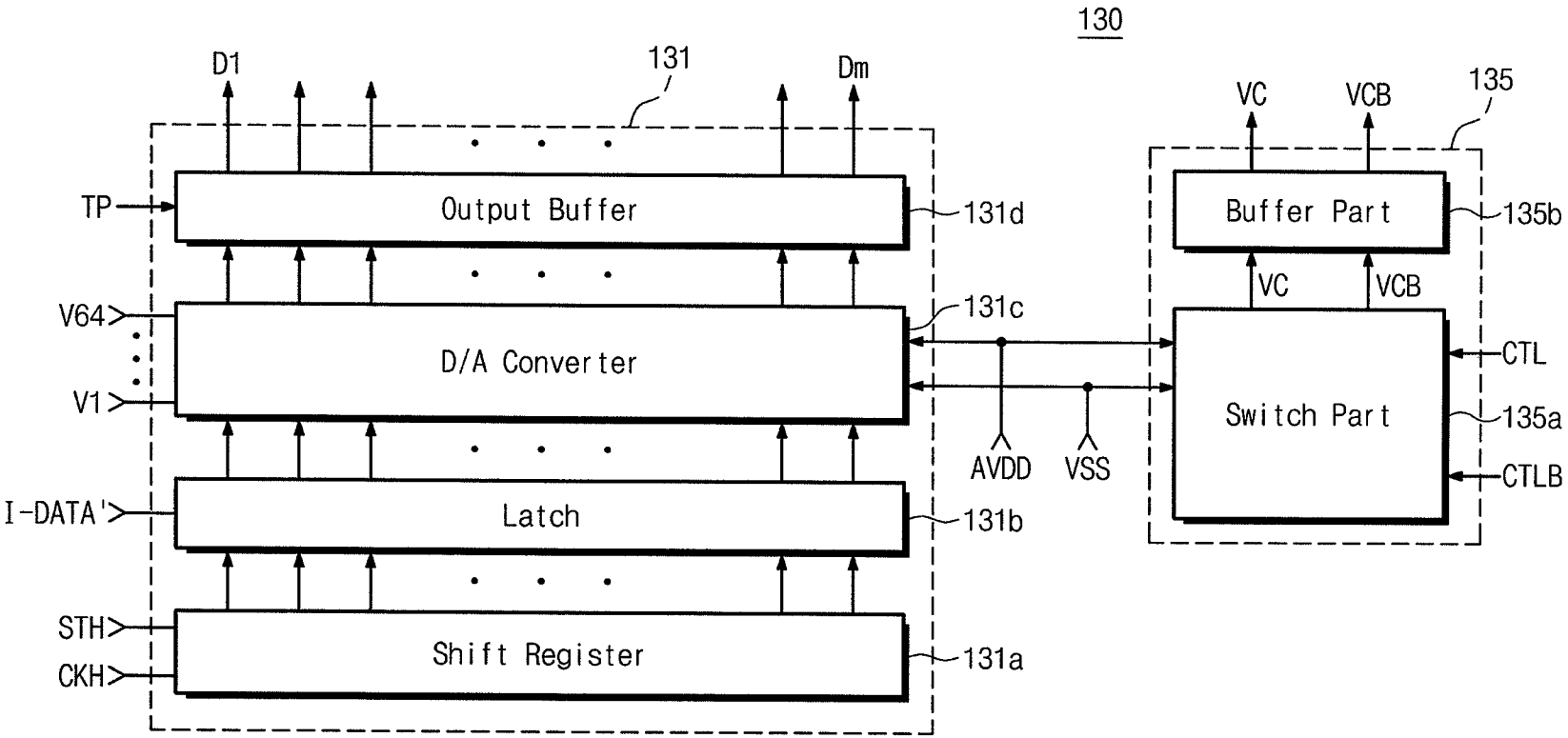
FIG. 2 is a block diagram showing a data driver that may be used in FIG. 1 according to an exemplary embodiment of the inventive concept.

FIG. 2 is a block diagram showing a data driver that may be used in FIG. 1 according to an exemplary embodiment of the inventive concept. Referring to FIG. 2, the data driver 130 includes a data output part 131 and a voltage generator 135. The data output part 131 includes a shift register 131*a*, a latch 131*b*, a digital-to-analog (D-A) converter 131*c*, and an output buffer 131*d*.

Although not shown in FIG. 2, the shift register 131*a* may include a plurality of stages connected to each other one after another, where the horizontal clock signal CKH is applied to each stage, and the horizontal start signal STH is applied to a first stage of the stages. When the first stage starts its operation in response to the horizontal start signal STH, the stages sequentially output a control signal in response to the horizontal clock signal CKH.

The latch 131*b* receives the control signal from the stages to store image signals corresponding to one line among the image signals I-DATA'. The latch 131*b* provides the stored image signals corresponding to the one line to the D-A converter 131*c*.

The D-A converter 131*c* converts the image signals provided from the latch 131*b* to the gray-scale voltages. The D-A converter 131*c* receives $2^k$ gray-scale voltages having a uniform level difference between the analog driving voltage AVDD and the ground voltage VSS. In at least one exemplary embodiment, k denotes a number of bits of each image signal and k is a positive integer equal to or greater than 1.

As an example, if each image signal has k=6 bits, the D-A converter 131*c* receives 64 gray-scale voltages V1~V64 (e.g., $2^6$ bits=64). However, the image signal may include a fewer or greater number of bits, and thus the D-A converter 131*c* may receive a fewer or greater number of gray-scale voltages. For example, if AVDD=15 volts and k=2, then gray-scale voltages of 0 volts, 5 volts, 10 volts, and 15 volts could be received. The D-A converter 131*c* selects the gray-scale voltages respectively corresponding to the image signals among the corresponding number of gray-scale voltages (e.g., 64 when 6 bit image data is used) and outputs the selected gray-scale voltages as the first voltages D1~Dm.

Although not shown in FIG. 2, the output buffer 131*d* may include a plurality of operational amplifiers (OP-amps) to temporarily store the first voltages D1~Dm output from the D-A converter 131*c* and output the first voltages D1~Dm in response to the output start signal TP at the same or substantially the same time.

Although not shown in FIG. 2, the D-A converter 131*c* may include a first gray-scale voltage group (hereinafter, referred to as "positive polarity group") and a second gray-scale voltage group (hereinafter, referred to as "negative polarity group") to enable the first voltages D1~Dm to have different polarities. The gray-scale voltages of the positive polarity group have a gray-scale that becomes higher as the gray-scale voltages become closer to the analog driving voltage AVDD from the ground voltage VSS, and the gray-scale voltages of the negative polarity group have a gray-scale that becomes higher as the gray-scale voltages become closer to the ground voltage VSS from the analog driving voltage AVDD. Accordingly, the D-A converter 131*c* may select the gray-scale voltages corresponding to the image signals from either the positive polarity group or the negative polarity group in response to the polarity reversal signal POL (e.g., see POL signal shown in FIG. 1).

The voltage generator 135 includes a switch part 135*a* and a buffer part 135*b*. The switch part 135*a* receives the analog driving voltage AVDD and the ground voltage VSS. The switch part 135*a* selects either the analog driving voltage AVDD or the ground voltage VSS in response to the first control signal CTL to output the analog driving voltage AVDD or the ground voltage VSS as the second voltage VC. The first control signal CTL may be a two-phase signal having logic high and low states and the first control signal CTL may swing between the logic high and low states in one frame unit.

The switch part 135*a* selects either the analog driving voltage AVDD or the ground voltage VSS in response to the second control signal CTLB to output the analog driving voltage AVDD or the ground voltage VSS as the third voltage VCB. The second control signal CTLB has a phase opposite to the first control signal CTL.

For example, if the first control signal CTL at the logic high state and the second control signal CTL at the logic low state are applied to the switch part 135*a* during a q-th frame, the switch part 135*a* may output the analog driving voltage AVDD as the second voltage VC and the ground voltage VSS as the third voltage VCB.

On the contrary, if the first control signal CTL at the logic low state and the second control signal CTL at the logic high state are applied to the switch part 135*a* during a (q+1)-th frame, the switch part 135*a* may output the ground voltage VSS as the second voltage VC and the analog driving voltage AVDD as the third voltage VCB.

Accordingly, the second voltage VC and the third voltage VCB may swing in one frame unit in response to the first and second control signals CTL and CTLB.

The buffer part 135*b* receives the second voltage VC and the third voltage VCB from the switch part 135*a* and amplifies the second voltage VC and the third voltage VCB. For example, when each of the second and third voltages VC and VCB is uniformly applied to the display panel 110 (shown in FIG. 1), second and third voltages VC and VCB having a larger voltage may be required. Therefore, the second and third voltages VC and VCB may be sufficiently amplified by the buffer part 135*b* before the second and third voltages VC and VCB are applied to the display panel 110.

While FIG. 2 illustrates a circuit configuration where the voltage generator 135 is distinct and separate from the data output part 131, the voltage generator 135 may be installed inside the data output part 131.

Figure 3:
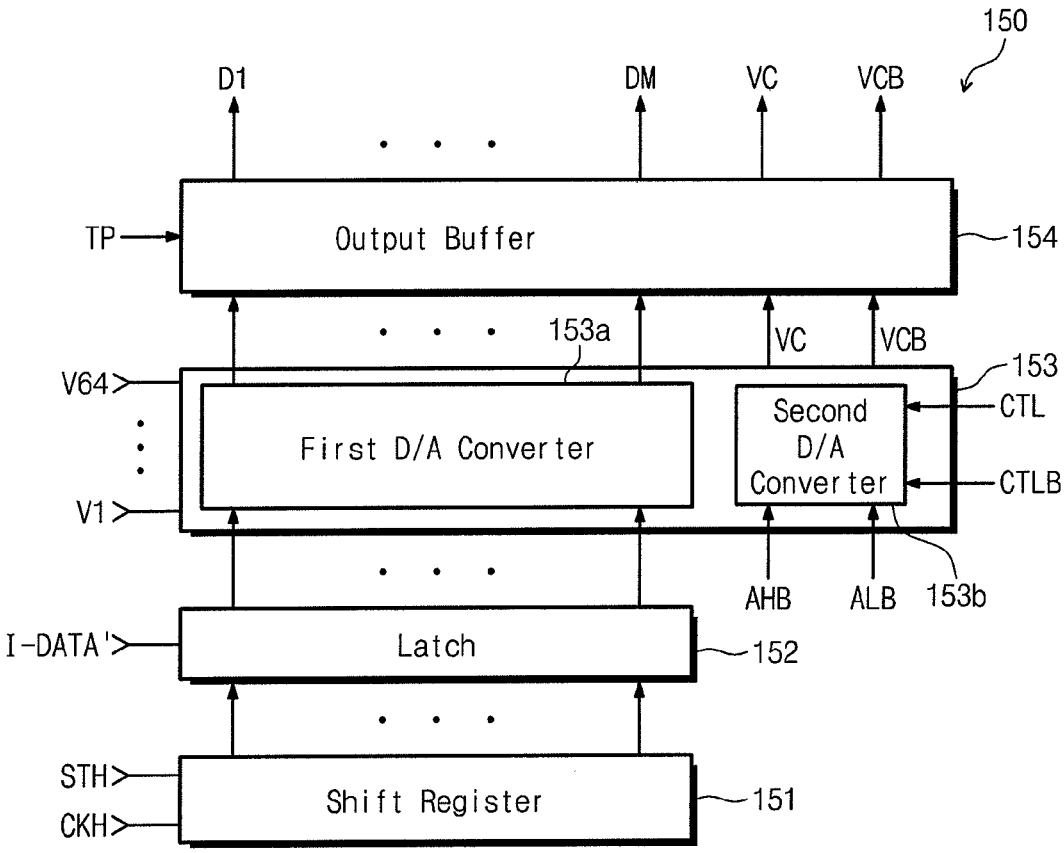
FIG. 3 is a block diagram showing a data driver that may be used in FIG. 1 according to an exemplary embodiment of the inventive concept.

FIG. 3 is a block diagram showing a data driver that may be used in FIG. 1 according to an exemplary embodiment of the inventive concept. Referring to FIG. 3, a data driver 150 includes a shift register 151, a latch 152, a converter part 153, and an output buffer 154. The shift register 151 and the latch 152 have the same circuit configuration and function as those of the shift register 131*a* and the latch 131*b* of FIG. 2.

The converter part 153 includes a first D-A converter 153*a* and a second D-A converter 153*b*. The first D-A converter 153*a* converts a plurality of image signals I-DATA' to a plurality of first voltages D1~Dm. The first D-A converter 153*a* selects gray-scale voltages corresponding to the image signals among a number of gray-scale voltages (e.g., V1~V64) and outputs the selected gray-scale voltages as the first voltages. Each image signal may be k bits, where k is a positive integer equal to or larger than 1.

For example, when k is 6 and the first voltage having a positive polarity is output, the first D-A converter 153*a* may convert the image signal of '111111' to the gray-scale voltage corresponding to 'V64' and convert the image signal of '000000' to the gray-scale voltage corresponding to 'V1'. On the contrary, when the first voltage having a negative polarity is output, the first D-A converter 153*a* may convert the image signal of '111111' to the gray-scale voltage corresponding to 'V1' and convert the image signal of '000000' to the gray-scale voltage corresponding to 'V64'.

The second D-A converter 153*b* alternately selects either a predetermined first reference signal AHB or a predetermined second reference signal ALB and outputs the first reference signal AHB or the second reference signal ALB in response to the first control signal CTL. The first and second reference signals AHB and ALB may have the k bits. Further, the k bits of the first reference signal AHB may be at a logic high state and the k bits of the second reference signal ALB may be at a logic low state.

For example, during a 1-st frame, the second D-A converter 153*b* selects the first reference signal AHB in response to the first control signal CTL at the logic high state, converts the selected first reference signal AHB to the gray-scale voltage corresponding to 'V64', and outputs the gray-scale voltage corresponding to 'V64'. Then, during the (q+1)-th frame, the second D-A converter 153*b* selects the second reference signal ALB in response to the first control signal CTL at the logic low state, converts the selected second reference signal ALB to the gray-scale voltage corresponding to 'V1', and outputs the gray-scale voltage corresponding to 'V1'.

Next, the second D-A converter 153*b* alternately selects either the first reference signal AHB or the second reference signal ALB in response to the second control signal CTLB, converts the selected first or second reference signal AHB or ALB to the third voltage VCB, and outputs the third voltage VCB. Accordingly, when the second D-A converter 153*b* converts the first reference signal AHB to the second voltage VC, the second D-A converter 153*b* converts the second reference signal ALB to the third voltage VCB, and when the second D-A converter 153*b* converts the second reference signal ALB to the second voltage VC, the second D-A converter 153*b* converts the first reference signal AHB to the third voltage VCB. As a result, the third voltage VCB may have a phase opposite to the second voltage VC.

The output buffer 154 outputs the first voltages D1~Dm output from the first D-A converter 153*a*. Further, the output buffer 154 may amplify the second and third voltages VC and VCB output from the second D-A converter 153*b*.

Figure 4:
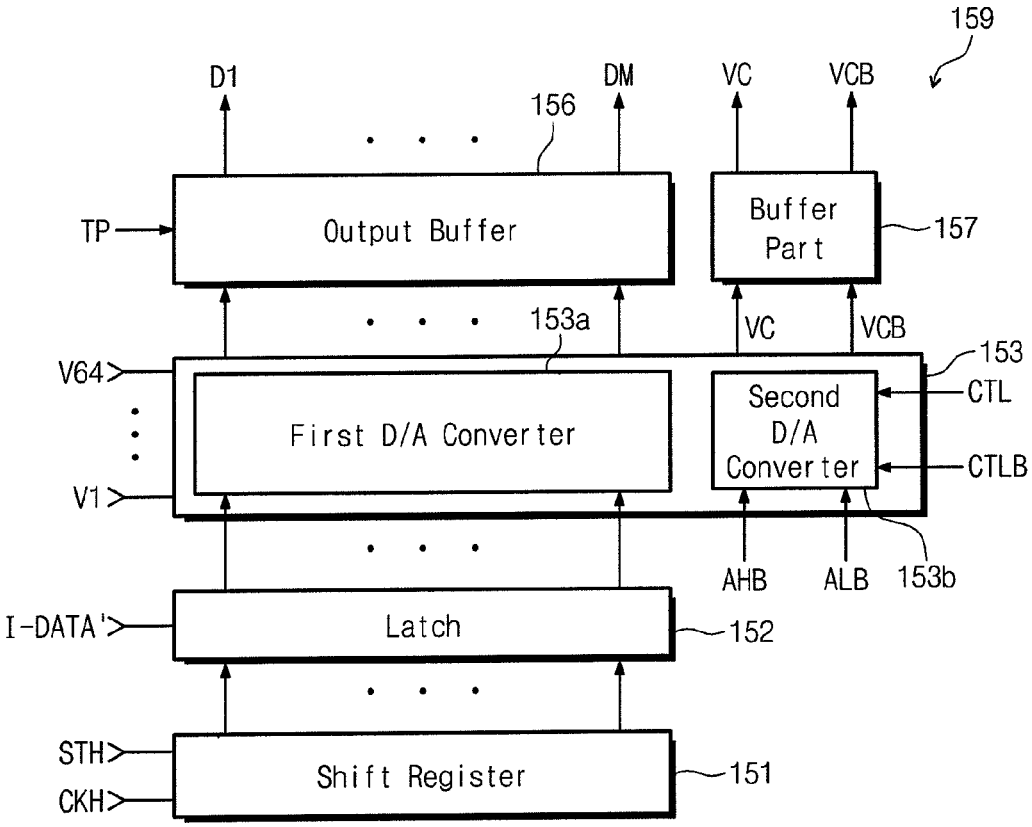
FIG. 4 is a block diagram showing a data driver that may be used in FIG. 1 according to an exemplary embodiment of the inventive concept.

FIG. 4 is a block diagram showing a data driver that may be used in FIG. 1 according to an exemplary embodiment of the inventive concept. In FIG. 4, the same reference numerals denote the same elements in FIG. 3, and thus detailed descriptions of the same elements will be omitted.

Referring to FIG. 4, a data driver 159 includes a shift register 151, a latch 152, a converter part 153, an output buffer 156, and a buffer part 157. The shift register 151 and the latch 152 have the same circuit configuration as those of the shift register 131*a* and the latch 131*b* in FIG. 2, and the converter part 153 includes first and second converters 153*a* and 153*b* as the converter part 153 shown in FIG. 3.

The output buffer 156 outputs the first voltages D1~Dm output from the first D-A converter 153*a*. Different from the data driver 150 shown in FIG. 3, the data driver 159 shown in FIG. 4 further includes a buffer part 157 separated from the output buffer 156.

The buffer part 157 amplifies the second voltage VC and the third voltage VCB output from the second D-A converter 153*b*. When the data driver 159 further includes the buffer part 157 separated from the output buffer 156, the second voltage VC and the third voltage VCB may be increased sufficiently.

FIG. 5A is an exemplary view showing a polarity of a first voltage applied to a display panel in a q-th frame, and FIG. 5B is an exemplary view showing a polarity of a first voltage applied to a display panel in a (q+1)-th frame.

Referring to FIGS. 5A and 5B, the polarity of the first voltage applied to each pixel is reversed in one frame unit. In addition, the two pixels adjacent to each other receive the first voltages having polarities different from each other.

When the first pixel Px receives the first voltage having the negative polarity (−) during the q-th frame Fq, the first pixel Px receives the first voltage having the positive polarity (+) during the (q+1)-th frame Fq+1. In addition, when the second pixel Py adjacent to the first pixel Px receives the first voltage having the positive polarity (+) during the q-th frame Fq, the second pixel Py receives the first voltage having the negative polarity (−) during the (q+1)-th frame Fq+1.

The polarity of the first voltages may be represented with reference to the second voltage VC or the third voltage VCB applied to each pixel.

Figure 6A:
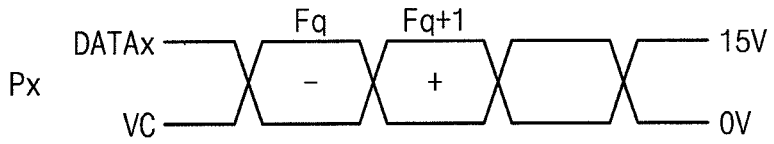
FIG. 6A is an exemplary waveform diagram showing first and second voltages applied to a first pixel of FIGS. 5A and 5B.
Figure 6B:
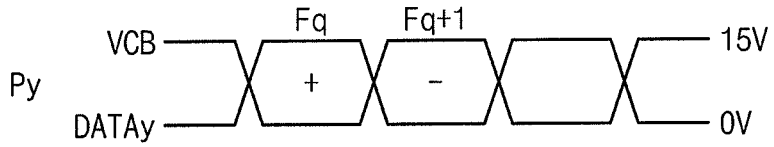
FIG. 6B is an exemplary waveform diagram showing first and third voltages applied to a second pixel of FIGS. 5A and 5B.

FIG. 6A is an exemplary waveform diagram showing first and second voltages applied to a first pixel of FIGS. 5A and 5B, and FIG. 6B is a waveform diagram showing first and third voltages applied to a second pixel of FIGS. 5A and 5B.

Referring to FIG. 6A, when assuming that the second voltage VC is applied to the first pixel Px and the first voltage applied to the first pixel Px is referred to as a first pixel voltage DATAx, the polarity of the first pixel voltage DATAx is reversed in one frame unit with respect to the second voltage VC. For example, when the first pixel voltage DATAx has the negative (−) polarity with respect to the second voltage VC during the q-th frame Fq, the first pixel voltage DATAx may have the positive (+) polarity with respect to the second voltage VC during the (q+1)-th frame.

The third voltage VCB having the opposite phase to the second voltage VC is applied to the second pixel Py adjacent to the first pixel Px. When assuming that the first voltage applied to the second pixel Py is referred to as a second pixel voltage DATAy, the polarity of the second pixel voltage DATAy is reversed in one frame unit with respect to the third voltage VCB. In other words, when the second pixel voltage DATAy has the positive (+) polarity with respect to the third voltage VCB during the q-th frame Fq, the second pixel voltage DATAy may have the negative (−) polarity with respect to the third voltage VCB during the (q+1)-th frame Fq+1.

Figure 7:
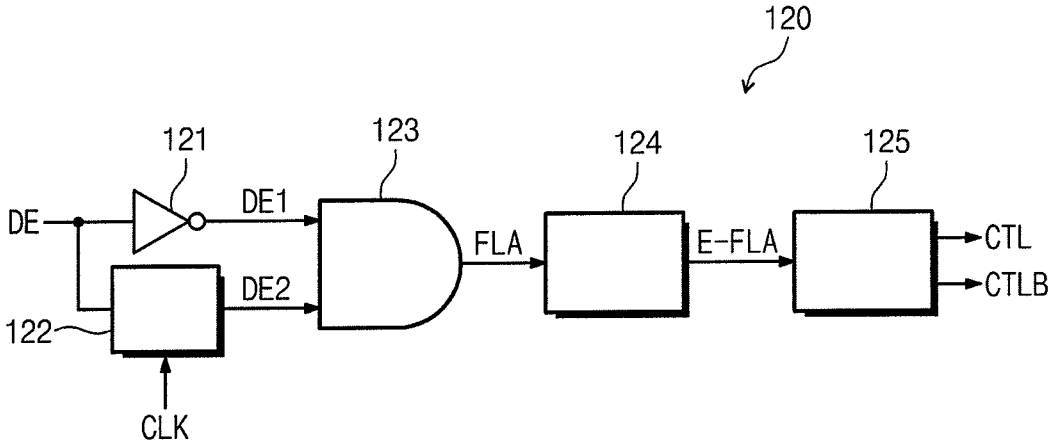
FIG. 7 is a block diagram showing a timing controller that may be used in FIG. 1 according to an exemplary embodiment of the inventive concept.
Figure 8:
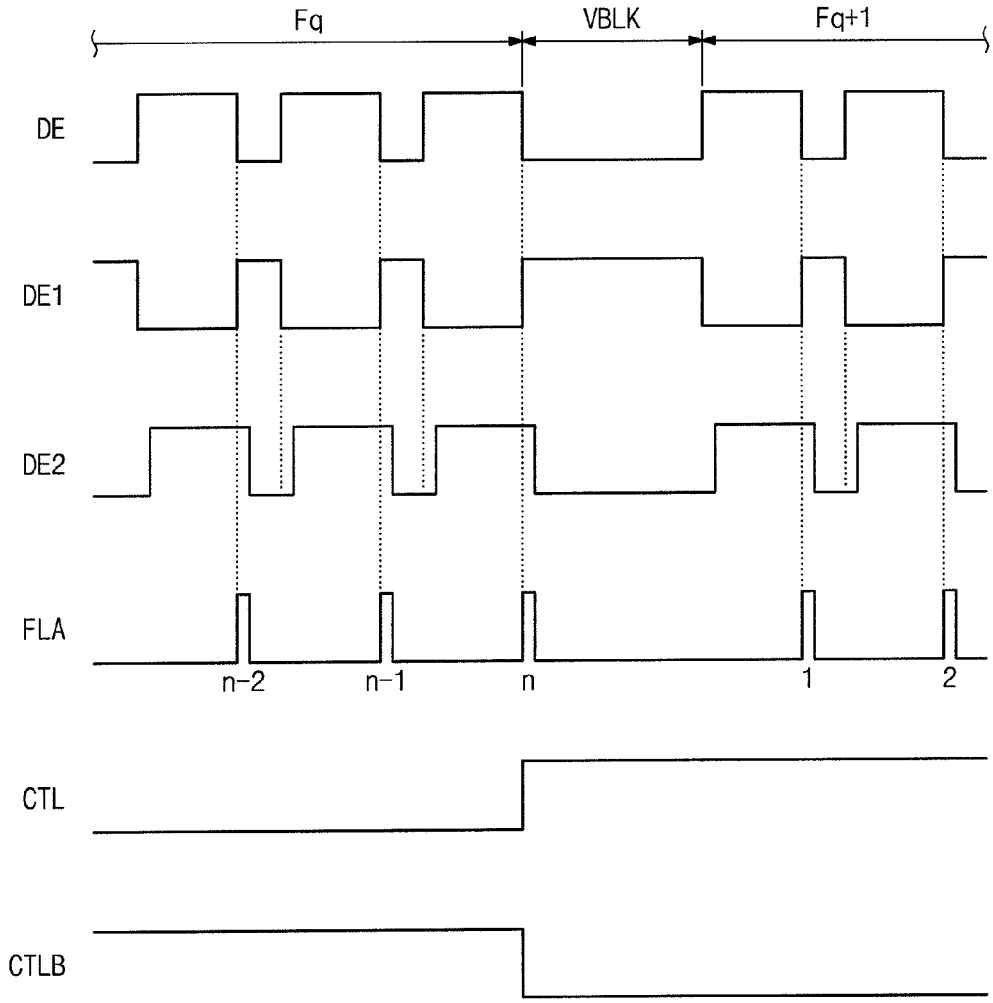
FIG. 8 is an exemplary timing diagram showing signals of FIG. 7.

FIG. 7 is a block diagram showing a timing controller of FIG. 1 according to an exemplary embodiment of the inventive concept and FIG. 8 is an exemplary timing diagram showing signals of FIG. 7. Referring to FIGS. 7 and 8, the timing controller 120 includes an inverter 121, a delayer 122, a logic circuit 123, a counter 124, and a state converter 125.

The inverter 121 inverts a data enable signal DE among the control signals Hsync, Vsync, MCLK, and DE applied to the timing controller 120 to output an inverted signal DE1. The delayer 122 delays the data enable signal DE by one clock of a predetermined reference clock signal CLK to output a delay signal DE2.

The logic circuit 123 logically ANDs the inverted signal DE1 with the delay signal DE2 to output a flag signal FLA. As shown in FIG. 8, the flag signal FLA has a logic high state during a period in which the flag signal DE1 and the delay signal DE2 are in the logic high state.

The counter 124 counts the high period of the flag signal FLA and outputs the last high period of one frame as an end flag signal E-FLA. For example, when assuming that n (e.g., where n is a positive integer equal to or larger than 1) gate signals G1~Gn are sequentially output during one frame, the counter 124 outputs the end flag signal E-FLA when the count value is n.

As shown in FIG. 8, the last high period E-FLA of the flag signal FLA includes a blank period VBLK between the q-th frame Fq and the (q+1)-th frame Fq+1.

The state converter 125 converts the state of the first and second control signals CTL and CTLB in response to the end flag signal E-FLA. For example, as shown in FIG. 8, the logic low state of the first control signal CTL is converted to the logic high state in the last high period E-FLA of the flag signal FLA, and the logic high state of the second control signal CTLB is converted to the logic low state in the last high period E-FLA of the flag signal FLA.

Accordingly, since the state of the first and second control signals CTL and CTLB is converted in the blank period VBLK, the second voltage VC and the third voltage VCB may be converted before the (q+1)-th frame Fq+1 starts. Consequently, a delay time margin of the second voltage VC and the third voltage VCB may be secured without increasing the second voltage VC and the third voltage VCB.

Figure 9:
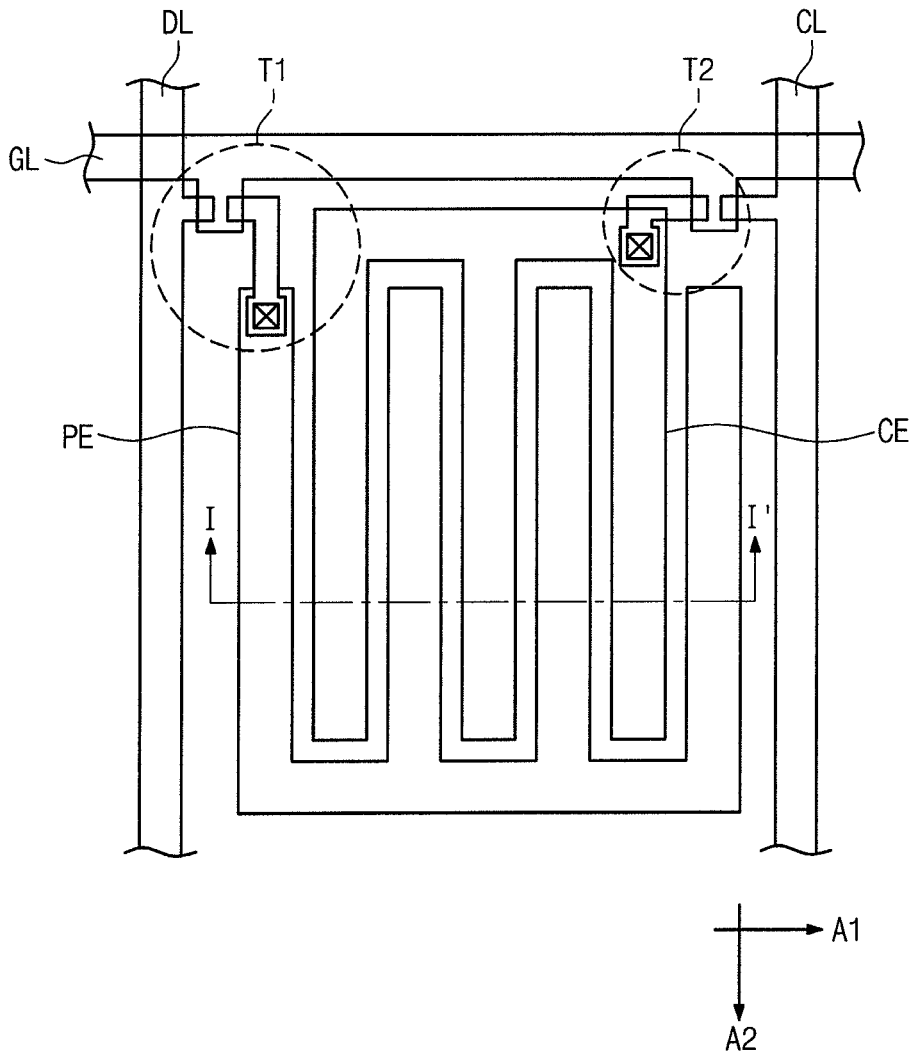
FIG. 9 is an exemplary layout showing a pixel of FIG. 1.
Figure 10:
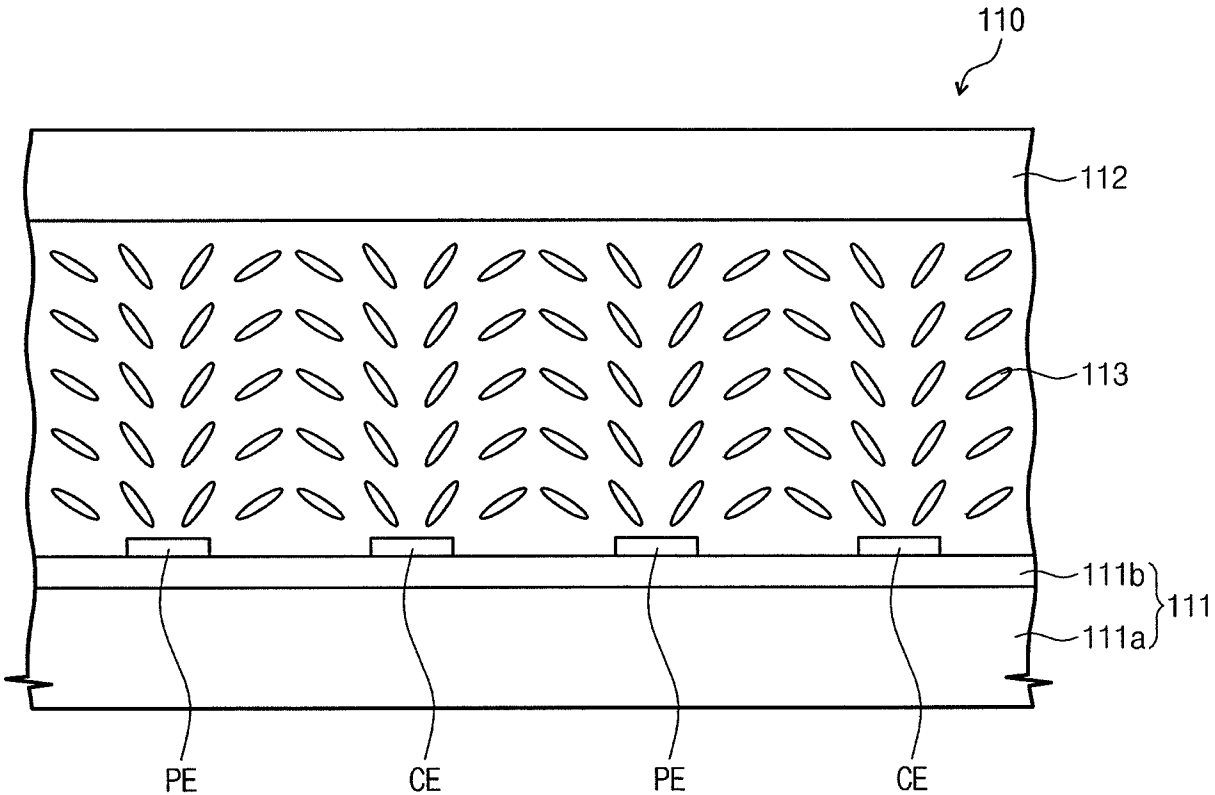
FIG. 10 is an exemplary cross-sectional view taken along a line I-I' of FIG. 9.

FIG. 9 is a layout showing an exemplary pixel of FIG. 1, and FIG. 10 is an exemplary cross-sectional view taken along a line I-I' of FIG. 9. The display panel 110 of FIG. 1 includes a plurality of pixels, but one or more of the pixels has the same layout. Thus, for ease of discussion, a layout of only one pixel has been shown in FIG. 9.

Referring to FIG. 9, a pixel includes the gate line GL, the first signal line DL, the second signal line CL, the first thin film transistor T1, the second thin film transistor T2, a first pixel electrode PE including a plurality of first pixel electrode sections, and a second pixel electrode CE including a plurality of second pixel electrode sections.

The gate line GL extends in a first direction A1 and the first and second signal lines DL and CL extend in a second direction A2, which may be substantially perpendicular to the first direction A1 to cross the gate line GL. The first signal line DL and the second signal line CL may be substantially parallel with each other and spaced apart from each other. The first and second thin film transistors T1 and T2, the first pixel electrode PE, and the second pixel electrode CE are arranged between the first signal line DL and the second signal line CL.

The first pixel electrode sections of the pixel electrode PE are spaced apart from each other and the second pixel electrode sections of the pixel electrode CE are arranged in spaces between the first pixel electrode sections, respectively. Ends of the first pixel electrode PE are electrically connected to each other and ends of the second pixel electrodes CE are electrically connected to each other.

The first thin film transistor T1 includes a gate electrode branched from the gate line GL, a source electrode branched from the first signal line DL, and a drain electrode connected to the first pixel electrode PE. The second thin film transistor T2 includes a gate electrode branched from the gate line GL, a source electrode branched from the second signal line CL, and a drain electrode connected to the second pixel electrode CE.

As shown in FIG. 10, the display panel 110 includes an array substrate 111, an opposite substrate 112 facing the array substrate 111, and a liquid crystal layer 113 interposed between the array substrate 111 and the opposite substrate 112.

The first pixel electrodes PE (e.g., the first pixel electrode sections) and the second pixel electrodes CE (e.g., the second pixel electrode sections) are arranged on the array substrate 111. The array substrate 111 further includes a base substrate 111*a* and an insulating layer 111*b* on the base substrate 111*a*. The first pixel electrodes PE and the second pixel electrodes CE are arranged on the insulating layer 111*b*, and each of the second pixel electrodes CE is positioned between two adjacent first pixel electrodes PE. Accordingly, the horizontal electric field is formed between one first pixel electrode and one second pixel electrode, which are adjacent to each other.

The liquid crystal layer 113 may include twisted nematic liquid crystals. The light transmittance of the liquid crystal layer 113 may be controlled by adjusting a tilting angle of each liquid crystal due to the horizontal electric field. While FIGS. 9 and 10 illustrate a pixel of a particular shape and configuration operated by the horizontal electric field, the pixel is not limited thereto.

Figure 11:
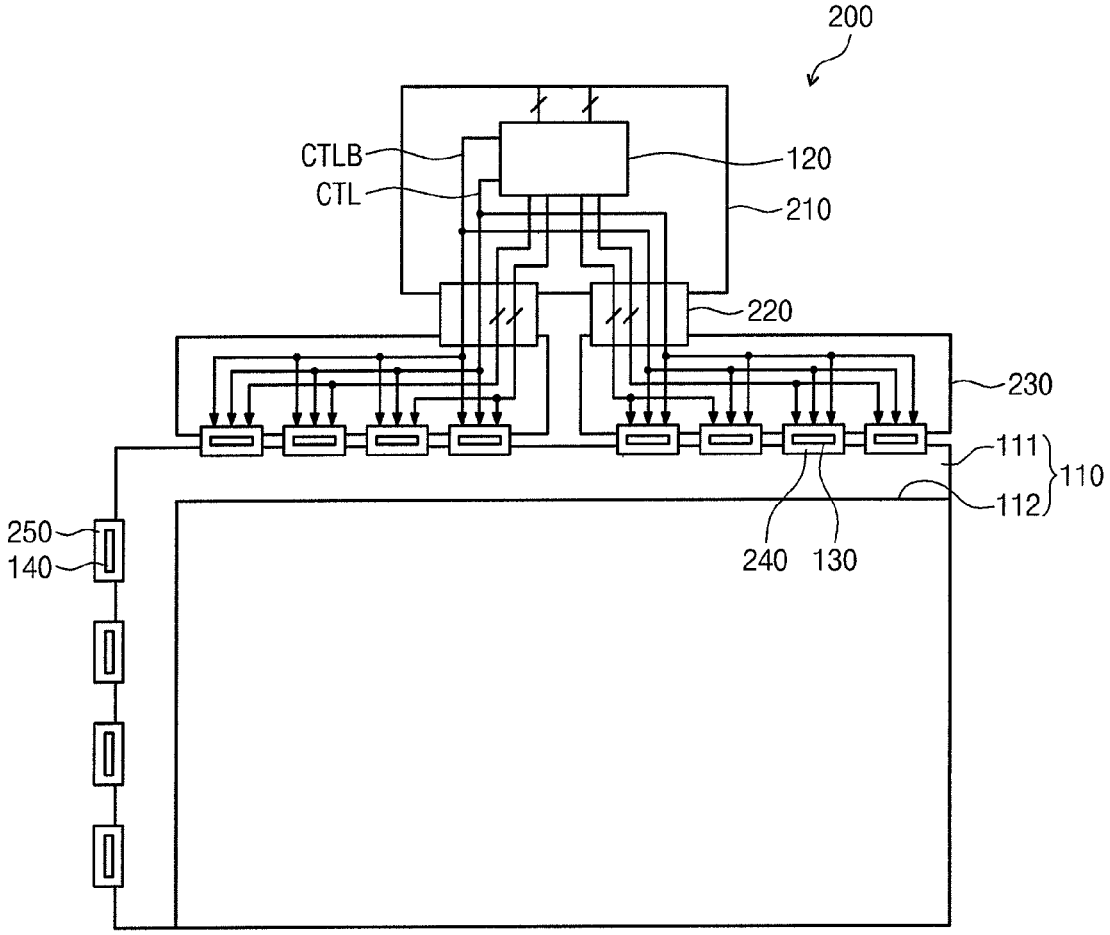
FIG. 11 is a plan view of a display apparatus according to an exemplary embodiment of the inventive concept.

FIG. 11 is a plan view of a display apparatus according to an exemplary embodiment of the inventive concept. Referring to FIG. 11, a display apparatus 200 includes a display panel 110, a control board 210 including a timing controller 120, a data driver 130 including a plurality of chips, a gate driver 140 including a plurality of chips, and a printed circuit board 230 provided between the control board 210 and the display panel 110. The printed circuit board 230 may be divided into two parts.

The data driver 130 in a chip form is arranged on a first chip-on-film 240 and the gate driver 140 in a chip form is arranged on a second chip-on-film 250. The first chip-on-film 240 is attached on one side of the display panel 110 and the second chip-on film 250 is attached on the other one side of the display panel 110.

The first chip-on-film 240 is electrically connected to the printed circuit board 230 and the printed circuit board 230 is electrically connected to the control board 210 via a connection film 220.

Thus, the image signals I-DATA' (refer to FIG. 1) and the data control signals STH, POL, TP, and CKH output from the timing controller 120 are provided to the data driver 130 via the connection film 220, the printed circuit board 230, and the first chip-on-film 240.

Further, the first and second control signals CTL and CTLB output from the timing controller 120 are provided to the data driver 130 via the connection film 220, the printed circuit board 230, and the first chip-on-film 240. Accordingly, the data driver 130 outputs not only first voltages, but also second and third voltages VC and VCB.

In at least one exemplary embodiment of the inventive concept, each of the second and third voltages VC and VCB is a square wave that swings between 0 volts and 15 volts and the first and second control signals CTL and CTLB has a voltage level of about 3.3 volts.

As described above, when the second voltage VC and the third voltage VCB are output from the data driver 130, the second voltage VC and the third voltage VCB may be applied to the display panel 110 without passing through the control board 210, the connection film 220, and the printed circuit board 230. Thus, the second voltage VC and the third voltage VCB may be more electrically stable and a circuit design of circuit boards for the display apparatus 200 may be simplified.

Although exemplary embodiments of the inventive concept have been described, it is to be understood that the inventive concept should not be limited to these exemplary embodiments and various changes and modifications can be made by one ordinary skilled in the art within the spirit and scope of the disclosure.

What is claimed is:

1. A display apparatus comprising:

a timing controller that outputs a plurality of image signals, a first control signal, a second control signal, and a third control signal;

a data driver that receives the image signals, the first control signal, the second control signal, and the third control signal and converts the image signals to data voltages in response to the first control signal, outputs the data voltages, a first common voltage swinging between two different voltage levels in at least one frame unit in response to the second control signal, and a second common voltage having a phase opposite to the first common voltage in response to the third control signal; and a display panel that includes a plurality of pixels, wherein at least one of the pixels receives a corresponding one of the first common voltage and the second common voltage to display an image and a corresponding data voltage of the data voltages from the data driver, wherein the data driver comprises:

a converter part that converts the image signals having n bits to the data voltages, alternately selects one of a predetermined first reference signal having n bits or a predetermined second reference signal having n bits, and converts the selected one of the first and second reference signals to the first common voltage and a remaining one of the first and second reference signals to the second common voltage; and an output buffer that outputs the data voltages output from the converter part, where n is a positive integer equal to or greater than 1.

2. The display apparatus of claim 1, wherein the n bits of the selected one of the first and second reference signals are at a logic high state and the n bits of the remaining one of the first and second reference signals are at a logic low state.

3. The display apparatus of claim 1, wherein the output buffer amplifies the first common voltage and second common voltage output from the converter part.

4. The display apparatus of claim 1, further comprising a buffer part that amplifies the first common voltage and second common voltage output from the converter part.

5. The display apparatus of claim 1, wherein the display panel comprises an array substrate, an opposite substrate opposite to the array substrate, and a liquid crystal layer interposed between the array substrate and the opposite substrate, and the plurality of pixels are arranged on the array substrate.

6. The display apparatus of claim 1, wherein each of the second and third control signals have one of a logic high state and a logic low state, and the timing controller toggles the state of each of the second and third control signals during a blank signal present between two successive frames.

7. The display apparatus of claim 6, wherein the timing controller comprises:

an inverter that converts a data enable signal of the first control signal to output an inverted signal;

a delayer that delays the data enable signal by a predetermined reference period to output a delay signal;

a logic circuit that logically ANDs the inverted signal with the delay signal to output a flag signal;

a counter that counts high periods of the flag signal to output a last high period of one frame as an end flag signal; and a state converter that toggles a state of the second and third control signals in response to the end flag signal.

8. The display apparatus of claim 1, further comprising:

a control board including the timing controller;

a chip-on-film attached on a side of the display panel, wherein the data driver is mounted on the chip-on-film in a chip form; and a printed circuit board connected between the chip-on-film and the control board to provide the image signals and the first and second control signals output from the timing controller to the data driver.

9. The display apparatus of claim 1, wherein the third control signal has a phase opposite to the second control signal.

10. The display apparatus of claim 1, wherein the plurality of pixels comprise a first pixel and a second pixel adjacent to each other, the first pixel and the second pixel receive the same gate signal, the first pixel receives a corresponding one of the data voltages of a first polarity during an entire frame period and the first common voltage to display an image, and the second pixel receives a corresponding one of the data voltages of a second opposite polarity during the entire frame period and the second common voltage to display the image during a same unit frame.

11. The display apparatus of claim 10, wherein each of the first pixel and the second pixel comprises:

a first transistor connected to a gate line that receives the same gate signal and a first signal line that receives the corresponding one of the data voltages;

a second transistor connected to the gate line and a second signal line that receives a corresponding one of the first common voltage and the second common voltage;

a first pixel electrode connected to a drain electrode of the first transistor; and a second pixel electrode that is adjacent to the first pixel electrode and connected to a drain electrode of the second transistor.

* * * * *